United States Patent [19]

Hrushesky

[11] Patent Number: 4,709,660

[45] Date of Patent: Dec. 1, 1987

[54] INSTRUMENT AND METHOD FOR ACCESSING VESSELS AND TISSUES WITHIN ANIMALS

[75] Inventor: William J. M. Hrushesky, Minneapolis, Minn.

[73] Assignee: Regents of the University of Minnesota, Minneapolis, Minn.

[21] Appl. No.: 720,423

[22] Filed: Apr. 5, 1985

[51] Int. Cl.[4] ..... A61D 3/00

[52] U.S. Cl. ..... 119/103

[58] Field of Search ..... 119/103, 96

[56] References Cited

U.S. PATENT DOCUMENTS 3,023,734 3/1962 Schaub ..... 119/103 X
3,094,101 6/1963 Porter ..... 119/103
3,103,204 9/1963 Greene ..... 119/103
3,187,721 6/1965 Cappel ..... 119/103

*Primary Examiner*—Robert P. Swiatek
*Attorney, Agent, or Firm*—Kinney & Lange

[57] ABSTRACT

A laboratory instrument and method used by a technician to gain access to vessels and tissues within the tail of an animal. The instrument includes a restrainer to restrict movement of the animal's body. A window supports the animal's tail. A light positioned opposite the window from the tail transilluminates the tail making the vessels and tissues therein visible. The vessels are dilated by heating the animal's body. Cannulating the vessels provides access thereto. The instrument is particularly useful for intravenous administration of drugs to rodents used in pharmocologic testing.

33 Claims, 7 Drawing Figures

10
14
16
18
19
30
35
40
44
46
48
60
62
63
64
65
66
94
100
102
103
104
108
108A
108B
110
112
114
116
118
120
121
122

INSTRUMENT AND METHOD FOR ACCESSING VESSELS AND TISSUES WITHIN ANIMALS

BACKGROUND OF THE INVENTION

1. Field of the Invention

The present invention relates to laboratory instruments and procedures. In particular, the present invention is an instrument and method for gaining access to vessels and tissues within tails of animals.

2. Description of the Prior Art

Drug toxicity, pharmacokinetics, and therapeutic effect are drastically affected by the route of drug administration. Intravenous preparations of most drugs given to human beings are available. In fact, many drugs can only be given to human beings intravenously. For these and other reasons, intravenous administration is the preferred method for preclinical drug development toxicology and pharmacologic testing.

Small animals such as rodents, primates and others having tails are used almost exclusively in these test procedures. It is, however, extremely difficult to intravenously administer drugs to these animals. The vessels within rats and mice are, in particular, small and difficult to find. The problem is compounded by the fact that the techician must hold the squirming animal in one hand while injecting it with the other. Most preclinical toxicologic and biologic drug testing protocols therefore employ intraperitoneal, subcutaneous, or intramuscular routes for parenteral drug administration.

Depsite these problems, intravenous administration is required in some situations. The most common route of intravenous injection is through the retroorbital vein behind the animal's eye. Another technique occasionally used involves opening the animal up and administering drugs to the major vein near the backbone or the inferior vena cava. It is also known that intravenous drug administration is facilitated by first dilating the vessels. This is sometimes done by heating the animals in an oven or dipping their lower body in hot water prior to drug administration.

Access to vessels and tissues of laboratory animals is also required for purposes other than intravenous drug administration. Many experimental procedures require continued access to vessels including veins, arteries and lymphatics. Purposes of this access include the removal of body fluids such as venous blood, arterial blood or lymph, and both long and short term infusion of various substances into these vessels. Cannulation of these vessels permits measurements to be made of such parameters as flow rate, resistance, compliance or pressure. Access to tissues including nerves, skin, connective tissue or bones permits a researcher to experiment on these tissues and to record their function, physical and physiological properties. By way of example, tensile strength of collagen from skin or ligaments, or the speed of propagation of an action potential along an isolated nerve, can be measured once access to these tissues is maintained. Unfortunately, procedures and measurements of those type have proven to be very difficult, primarily for the same reasons described above with regard to intravenous injection. Continued access to these vessels and tissues within the animal is not easily achieved.

Preclinical drug development toxicology, pharmacologic testing, and other experiments are time consuming but important procedures. The results of these tests are used to direct further medical research. Accuracy is imperative. It would, therefore, be desirable to easily access vessels and tissues of laboratory animals. What is needed is an apparatus and method permitting laboratory technicians to quickly locate and access these vessels and tissues. It is also desirable that the apparatus and method adequately restrain the animal to permit continued access. A system of this type would be particularly useful to technicians intravenously administering drugs to rodents.

SUMMARY OF THE INVENTION

The present invention is a laboratory instrument to assist in gaining access to vessels and tissues within the tail of an animal used for experimentation or pharmacologic testing. Included are means for restraining movement of the animal, means for supporting the tail, and means for transilluminating the tail to make vessels and tissues therein visible. A preferred embodiment includes means for heating the animal to cause dilation of the vessels. The instrument permits a laboratory technician to quickly locate tail vessels and tissues permitting infusion or removal of fluids from the vessels, and experimentation upon the tissues.

In other preferred embodiments the means for restraining movement of the animal comprises a hollow tube which has a first end portion which is enclosed and a second end portion which is open. The hollow tube forms a chamber to receive a body of the animal. The means for supporting the tail includes a window which is positioned adjacent to the second end portion of the hollow tube. The second end portion of the tube is enclosed by a wall having a notch on a lower edge. The tail of the animal extends from the second end portion of the tube, through the notch in the wall, and is clamped to the window. A light is positioned adjacent to the window to transilluminate the tail.

In other embodiments, a resistance heater is mounted to the hollow tube to heat the body of the animal and cause dilation of the vessels in the tail. Temperature of the heater is regulated by a temperature control. A shutter forms an aperture directing light to the tail. The shutter is adjustable for tails of varying size. An inflatable bellows mounted within the hollow tube provides additional restraint for larger animals.

DETAILED DESCRIPTION OF THE PREFERRED EMBODIMENTS

Figures 1, 2, 5:
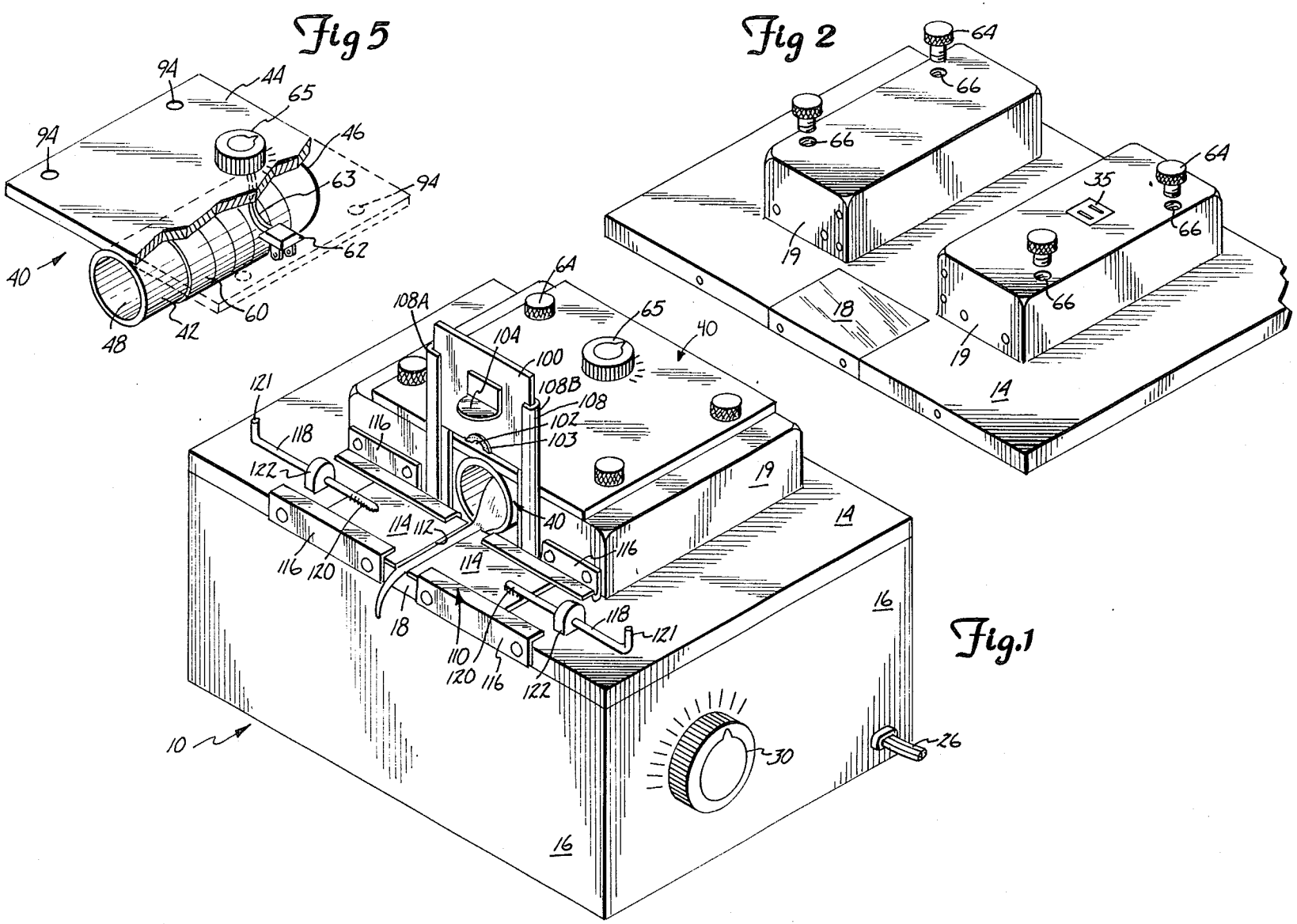
FIG. 1 is a perspective view of the laboratory instrument.
FIG. 2 is a perspective view of the top panel of the instrument, shown with the restrainer, gate and shutter removed.
FIG. 5 is a perspective view of the mouse restrainer with parts thereof cut away.

A major metabolic problem faced by warm blooded mammals is the maintenance of body temperature within a range of about 2° C. The effective dissipation of excess heat is the most critical factor in maintaining temperature homeostasis. Two major anatomic sites of heat dissipation in animals are the ears and the tail. These "organs" cool the blood by shunting or receiving additional blood when the animal is overheated. By heating the animal, tail vessels can be made to increase in size three to ten times. Intravenous injection at this site is made much easier. The application of pressure to the tail, lower than arterial pressure but greater than venous pressure, causes further dilation of these vessels. Transillumination of the tail by a source of light makes the vessels and tissues within the tail clearly visible. Before any of these properties can be put to use, however, movement of the animal must first be effectively restrained.

The present invention is a novel laboratory instrument and procedure which permits a technician to make use of the properties described above to gain access to vessels and tissues within the tail of animals. It is to be understood that the term vessels includes veins, arteries and lymphatics, while the term tissues includes nerves, skin, connective tissue and bone. There are many purposes for which it is desired to access these vessels and tissues, some of which are described in the Description of the Prior Art. Although the embodiments described below are designed for rodents, such as mice and rats, it is to be understood that the concept disclosed and claimed is in no way limited to these animals. The invention is equally well suited for use with any animal having a tail. It is envisioned, however, that the present invention will be particularly useful as an aid to intravenous injection of drugs to rodents.

The laboratory instrument of the present invention is best described with reference to FIGS. 1–3. Base 10 is a light-tight rectangular box which includes bottom panel 12, top panel 14, and side panels 16. Base 10 is formed of any suitable material including wood, composition board, plastic, or metal. Window 18 is mounted within top panel 14 of base 10. In the embodiment shown, window 18 is positioned near an edge of panel 14. Window 18 is formed of light propagating material such as glass or plastic. In preferred embodiments, window 18 is transparent. Window 18 provides support for the tail of the animal while, at the same time, propagating light.

Also fastened to top panel 14 are mounts 19. As best shown in FIG. 2, mounts 19 are blocks of wood, plastic or similar material positioned on either side of and in line with window 18. As is described in detail in subsequent portions of this specification, mounts 19 are a convenient means of attaching different restraining devices for different sized animals to base 10. Other mounting systems are, however, equally well suited for this purpose.

Electrical apparatus contained within base 10 is best described with reference to FIGS. 2-4. Positioned directly below window 18 is a source of light, such as light bulb 20. Light bulb 20 is screwed into electrical socket 22. Socket 22 is in turn mounted to bottom panel 12 of base 10 by L-shaped bracket 24. Bottom reflector 32 is mounted to bottom panel 12 directly below light bulb 20. Side reflectors 34 (one is shown in FIG. 4) are mounted to side panels 16. Bottom and side reflectors 32 and 34, respectively, focus light from bulb 20 onto window 18. As best shown in FIG. 2, an electrical connector, such as socket 35, is mounted to a top surface of one mount 19. Socket 35 is a convenient means of supplying electric power to the different restraining devices which are fastened to mounts 19. This feature is described in detail in subsequent portions of this specification.

Figure 3:
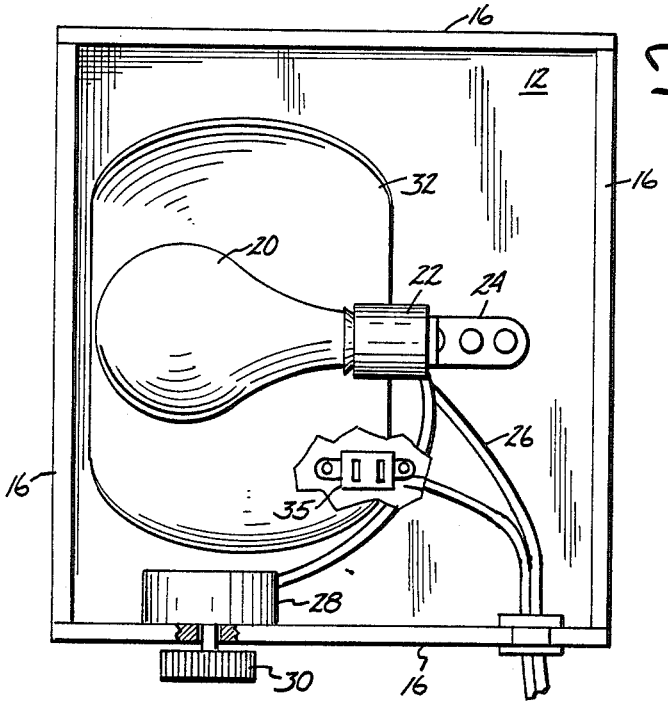
FIG. 3 is a sectional top view of the instrument, illustrating the interior of the base.
Figure 4:
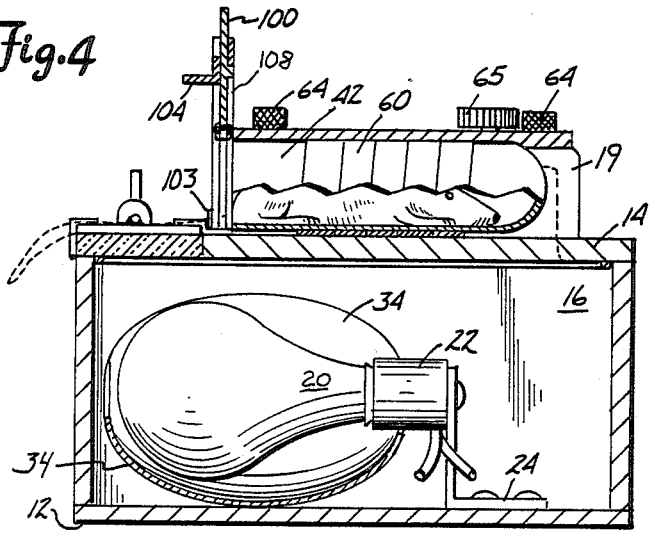
FIG. 4 is a sectional side view of the instrument.

In the embodiment shown in FIGS. 1, 3 and 4, electric power is supplied to light bulb 20 and socket 35 from a standard 120 V AC outlet through power cord 26. Other embodiments include batteries or a rechargeable power source for this purpose. A rheostat 28 is preferably included to vary intensity of the light produced by light bulb 20. Rheostat 28, and thus the light intensity from light bulb 20, is adjusted by dial 30. Dial 30 is positioned on a side panel 16 to permit easy access by the technician.

The laboratory instrument of the present invention is adapted for use with small and large tailed animals. Separate restraining devices for use with each of these animals are provided. A preferred embodiment of small animal (mouse) restrainer 40 is illustrated in FIG. 5. As shown, small animal restrainer 40 includes a hollow tube 42 mounted to a lower face of mounting plate 44. Hollow tube 42 includes closed end 46 and open end 48. Hollow tube 42 need only be large enough to restrain movement of a small animal. To this end, a tube having a diameter of approximately one inch and a length of approximately two and one-half inches has been found to work well for a 25 gram mouse. In preferred embodiments, hollow tube 42 is formed of opaque, preferably black, plastic material.

Small animal restrainer 40 includes a heating element 60 for applying heat to the animal's body. In the embodiment shown in FIG. 5, heating element 60 is a resistance heater wound around the exterior of tube 42. Plug 62 is fastened to a lower face of mounting plate 44. Plug 62 is adapted to fit within socket 35 when restrainer 40 is fastened to mounts 19. Electric power is supplied to heating element 60 through plug 62 and power cord 63. Temperature control 65, shown mounted to the top face of plate 44, is used to regulate temperature of heater 60. In preferred embodiments, temperature of heater 60 can be varied between room temperature and 45° C. with temperature control 65.

Figure 6:
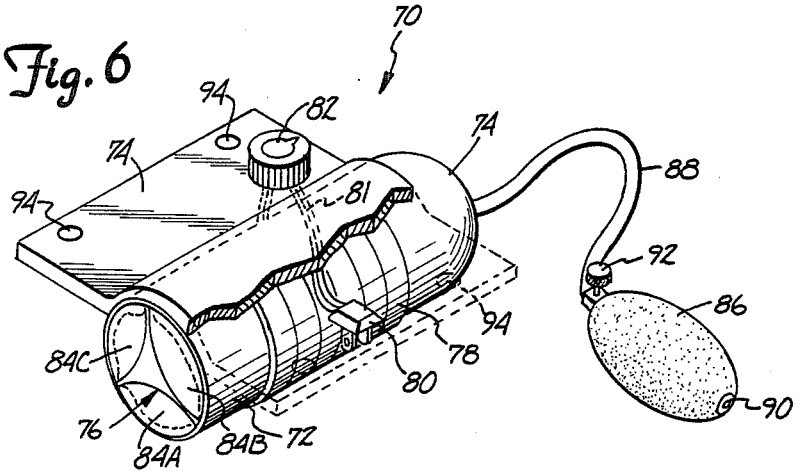
FIG. 6 is a perspective view of the rat restrainer, with parts thereof cut away.

A preferred embodiment of large animal (rat) restrainer 70 is illustrated in FIG. 6. Large animal restrainer 70 includes a hollow tube 72 securely fastened to a lower face of mounting plate 74. Hollow tube 72 includes closed end 74 and open end 76. The diameter and length of tube 72 are sized appropriately to restrain larger animals, such as rats or primates. Like small animal restrainer 40, restrainer 70 includes a heater 78, plug 80, power cord 81 and temperature control 82. These devices are similar to their previously described counterparts, and function in an identical manner.

Rats, being larger and stronger than mice, are more difficult to properly restrain. When trapped within tube 72 they will often "spin" making it very difficult to puncture a vessel. The skin surrounding a rat's tail is also much thicker, often making repeated punctures necessary. For this reason, large animal restrainer 70 includes inflatable bellow 84 which are mounted to the interior surface of hollow tube 72. The embodiment shown includes three bellow panels 84A–84C, each extending the full length of hollow tube 72 and around one-third of the inner circumference. Bellows 84A–84C are inflated by hand pump 86 which forces air through tube 88. Check valve 90 prevents bellows 84 from being overinflated. This form of restraint also results in increasing venous pressure within the rat and thus distending tail veins making them easier to locate and cannulate. Release valve 92 is actuated to deflate bellows 84 when it is desired to remove the rat.

As shown in FIGS. 5 and 6, mounting panels 44 and 74 of small animal restrainer 40 and large animal restrainer 70, respectively, include bores 94. When restrainers 40 or 70 are positioned onto mounts 19, plug 62 or 80, respectively, will fit within socket 35 while bores 94 align with threaded bores 66. Hand bolts 64 are screwed into bores 66 to secure the restrainer 40 or 70 to mounts 19. In this manner, the open end 48 or 76 of restrainers 40 or 70 is secured adjacent to window 18. Other means for fastening the restrainers to base 10 are equally well suited.

Figure 7:
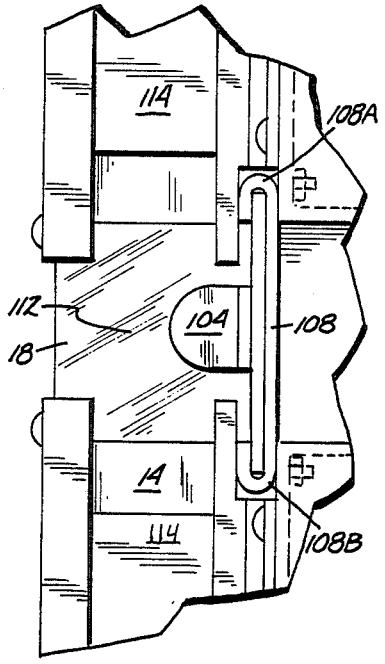
FIG. 7 is a detailed top view illustrating the gate.

As best shown in FIGS. 1 and 7, a frame 108 formed of two elongated C-shaped track members 108A and 108B is fastened to mounts 19 at a point adjacent to both window 18 and the open end 48 or 76 of small animal restrainer 40 or large animal restrainer 70, respectively. C-shaped track members 108A and 108B open toward each other and form a mount for slidable gate 100. Gate 100 slides between an upper position, as shown in FIG. 1, and a lower position enclosing open end 48 or 76 of restrainer 40 or 70, respectively. Handle 104 is fastened to gate 100 to facilitate this movement by the technician.

When lifted to its upper position, gate 100 permits access to open end 48 or 76 of restrainer 40 or 70, respectively. When closed, gate 100 encloses the animal within the restrainer. Gate 100 includes a notch 102 on a lower edge. The tail of the animal will extend through notch 102 and be clamped to window 18 when gate 100 is in its lower position. Preferred embodiments of the present invention include a grommet 103 made of semi-rigid material, such as rubber, mounted to notch 102. Grommet 103 acts as a tourniquet, applying pressure to the tail and causing dilation of the vessels therein. This pressure can be released by raising gate 100 a short distance.

The present invention also includes shutter 110 for varying the size of aperture 112 through which light is propagated to the animal's tail. Shutter 110 is formed by two shutter plates 114, each of which is mounted on either side of a center of window 18. Shutter plates 114 are slidably mounted to base 10 by flanges 116. Shutter plates 114 are moved by L-shaped push rods 118. As shown, each push rod 118 includes a first end 120 which is fastened by suitable means to a shutter plate 114, and a second end 121. Push rods 118 are slidably mounted to top panel 14 of base 10 by friction bushings 122. By grasping second ends 121 and moving push rods 118, a technician can adjust aperture 112 to a desired size.

A lab technician will use the invention described above as follows. Depending upon the type of animal to be injected, either small animal restrainer 40 or large animal restrainer 70 will be fastened to base 10 by hand bolts 64. The technician will then grasp handle 104 and raise gate 100 to its upper position permitting access to the open end 48 or 76 of the respective hollow tube 42 or 72. The test animal is then removed from its cage by grasping either its body or its tail and set in front of the opening. The natural tendency of rodents is to hide. Since the hollow tubes are formed of black material, it is dark inside and the animal will quickly run headfirst into the tube to escape the technician. No force or urging on the part of the technician is required. Gate 100 is then slid to its lower position so that the animal is enclosed within hollow tube 42 or 72. The tail of the animal will extend out hollow tube 42 or 72 through notch 102 and be clamped to window 18 by grommet 103 of gate 100. In this way, the technician has access to the full length of the animal's tail while it is restrained. If testing is being performed on larger animals, more restraint may be required. This is accomplished by operating hand pump 86 to inflate bellows 84.

Next, the technician actuates push rods 118 to adjust aperture 112 to a width equal to that of the animal's tail. Aperture 112 and shutter plates 114 also form a groove which acts to steady and prevent movement of the animal's tail during the laboratory procedure. The technician then transilluminates the tail by actuating light dial 30.

Once transilluminated, all vessels and tissues within the tail are clearly visible and distinguishable. Vessels, for example, are darker in color than the skin and other material of the tail. In most instances, these procedures are adequate to permit the technician to cannulate the vessels and inject or remove substances. Since the animal is restrained the procedure can be continued for a desired time period. Tissues within the tail are also visible and available for experimentation. If it is desired to inject substances, the technician will hold the tail with one hand and inject the substance into the appropriate vessel with the other hand.

In some instances, particularly with mice, tail vessels may be too small to easily access, even though they are visible. This problem is overcome by setting temperature control 65 or 82 of restrainers 40 and 70, respectively, to heat the animal. This causes the vessels to increase in size three to ten times. Intravenous injection at the site is made much easier. Once the injection has been performed, the technician lifts gate 100 by handle 104 and pulls the animal from the tube by its tail. The animal is then easily placed back into its cage. Typically, the animal can be placed within the restrainer, injected and removed in about 30 seconds.

Although the present invention has been described with reference to preferred embodiments, workers skilled in the art will recognize that changes may be made in form and detail without departing from the spirit and scope of the invention.

What is claimed is:

1. A laboratory instrument to assist in gaining access to vessels and tissues within a tail of an animal used for experimentation and pharmacologic testing, comprising:

a base;

restraint means mounted with respect to the base for restraining movement of the animal while exposing and permitting access to the tail;

support means mounted with respect to the base and positioned for supporting the tail as exposed from the restraint means;

transilluminating means mounted with respect to the base for transilluminating the tail to make vessels therein visible;

shutter means mounted with respect to the transilluminating means and forming an aperture through which light is propagated to the tail; and means attached to the shutter means for varying a width of the aperture.

2. The instrument of claim 1 and including means mounted with respect to the base for heating the animal to cause dilation of the vessels.

3. The instrument of claim 2 wherein the means for heating the animal includes a resistance heater mounted to the base.

4. The instrument of claim 3 and including a temperature control coupled to the resistance heater for regulating temperature of the heater.

5. The instrument of claim 1 and including means mounted with respect to the base for applying releasable pressure to a base of the tail to cause dilation of the vessels.

6. The instrument of claim 5 wherein the means for applying releasable pressure to the tail includes a semicircular member movably mounted with respect to the base which forces a portion of the base of the tail against the support means for supporting the tail.

7. The instrument of claim 1 wherein the restraint means for restraining movement of the animal includes a chamber mounted to the base for receiving the animal, the chamber having a first end portion which is closed and a second end portion which is open.

8. The instrument of claim 7 and including inflatable bellows mounted inside the chamber for further restraining movement of the animal when inflated.

9. The instrument of claim 1 and including means mounted with respect to the base for immobilizing the animal's tail.

10. The instrument of claim 9 wherein the means for immobilizing the animal's tail includes means movably mounted with respect to the restraint means for clamping a base of the animal's tail to the support means for supporting the tail.

11. The instrument of claim 1 wherein the support means for supporting the tail is formed of light propagating material.

12. The instrument of claim 1 wherein the transilluminating means for transilluminating the tail includes a source of visible light.

13. The instrument of claim 12 and including means coupled to the transilluminating means for varying intensity of the light.

14. The instrument of claim 1 and further including releasable fastener means for releasably fastening the restraint means to the base.

15. A laboratory instrument to assist a technician in gaining access to vessels and tissues within a tail of an animal used for experimentation, comprising:

a base;

restrainer means mounted to the base for restraining movement of the animal;

window means positioned on the base adjacent to the restrainer means for supporting the tail and for propagating light to the tail;

light means mounted with respect to the window means for impinging light upon the window means to transilluminate the tail and make vessels and tissues therein visible; and shutter means mounted with respect to the window means and forming an aperture through which light is propagated to the tail.

16. The instrument of claim 15 and including heater means mounted with respect to the restrainer means for heating a body of the animal to cause dilation of the vessels.

17. The instrument of claim 16 and including a temperature control coupled to the heater means for regulating temperature of the heater means.

18. The instrument of claim 15 and including adjustment means attached to the shutter means for varying a width of the aperture.

19. The instrument of claim 15 and including means coupled to light means for varying intensity of the light impinged upon the window means by the light means.

20. The instrument of claim 15 wherein the restrainer means includes:

a hollow tube mounted to the base and having a first end portion which is closed and a second end portion which is open, the hollow tube forming a chamber for receiving a body of the animal; and a wall positioned adjacent the second end of the hollow tube and having a notch on a lower edge for enclosing the second end portion of the hollow tube to cause the tail of the animal to extend from the secnd end portion of the tube through the notch and rest on the window means.

21. The instrument of claim 20 and including means mounted to the wall for sliding the wall between a first position which allows the animal to enter the tube through the second end portion, and a second position which encloses the animal within the tube.

22. The instrument of claim 20 and including inflatable bellows mounted inside the hollow tube for further restraining movement of the animal when inflated.

23. The instrument of claim 22 and including pump means coupled to the bellows for inflating the bellows with air.

24. The instrument of claim 20 and including a grommet lining the notch in the wall, the grommet applying pressure which causes dilation of the vessels while clamping the tail to the window.

25. The instrument of claim 24 wherein the grommet is formed of rubber-like material.

26. The instrument of claim 15 and further including releasable fastener means for releasably fastening the restrainer means to the base.

27. A laboratory instrument for restraining movement of a rodent and for transilluminating a tail of the rodent to make vessels and tissues therein visible to aid in intravenous injection of drugs, the laboratory instrument comprising:

a hollow base including a top panel;

a window formed of light propagating material positioned on the top panel of the base for supporting the tail;

a light positioned within the base for transilluminating the tail through the window;

a shutter positioned adjacent to the window and forming an aperture through which light is propagated to the tail;

means attached to the shutter for varying a width of the aperture;

a hollow tube mounted to a top surface of the top panel having a first end portion which is closed and a second end portion which is open and positioned adjacent to the window, the hollow tube forming a chamber to receive the rodent; and a wall slidably mounted to the base adjacent the second end portion of the hollow tube and having a notch in a lower edge, the wall being slidable between an upper position which allows the rodent to enter the tube, and a lower position which encloses the rodent within the tube and clamps the tail to the window.

28. The instrument of claim 27 and including a resistance heater positioned on the hollow tube for heating the rodent to cause dilation of the vessels.

29. The instrument of claim 28 and including an adjustable temperature control for regulating an amount of heat applied to the rodent by the resistance heater.

30. The instrument of claim 27 and including a means for controlling intensity of light transilluminating the tail.

31. The instrument of claim 27 and including inflatable bellows positioned inside the hollow tube for further restraining movement of the rodent when inflated.

32. The instrument of claim 27 and including a rubber-like grommet lining the notch in the wall for applying pressure to cause dilation of the vessels while clamping the tail to the window.

33. The instrument of claim 27 and further including releasable fastener means for releasably fastening the hollow tube to the top panel of the base.

* * * * *